United States Patent [19]

Hertrich et al.

[11] 3,995,850

[45] Dec. 7, 1976

[54] FOLDING OF SHEET-MATERIAL BLANKS

[75] Inventors: Klaus Hertrich, Goehrenz; Horst Fenske, Leipzig, both of Germany

[73] Assignee: Veb Polygraph Leipzig Kombinat fur Polygraphische Maschinen und Ausrustungen, Leipzig, Germany

[22] Filed: Jan. 9, 1975

[21] Appl. No.: 539,736

Related U.S. Application Data

[62] Division of Ser. No. 301,603, Oct. 27, 1972, Pat. No. 3,904,187.

[52] U.S. Cl. ..... 270/83

[51] Int. Cl.[2] ..... B65H 45/18

[58] Field of Search ..... 270/67, 83–85, 270/80; 74/25

[56] References Cited

UNITED STATES PATENTS

| | | | |
|---|---|---|---|
| 1,867,909 | 7/1932 | Deligianes | 270/67 |
| 1,960,682 | 5/1934 | Sokolow | 270/67 |
| 2,470,754 | 5/1949 | Alber | 270/83 |
| 2,655,843 | 10/1953 | Baker | 93/51 R |
| 2,837,013 | 6/1958 | Pagendarm | 93/36.01 |
| 3,186,244 | 6/1965 | Baker | 74/40 |

FOREIGN PATENTS OR APPLICATIONS

| | | | |
|---|---|---|---|
| 1,108,498 | 6/1961 | Germany | 270/83 |
| 1,238,490 | 4/1967 | Germany | 270/83 |

*Primary Examiner*—J. Reed Fisher
*Assistant Examiner*—A. Heinz
*Attorney, Agent, or Firm*—Michael J. Striker

[57] ABSTRACT

A sheet-material blank is advanced in a path and from laterally of the path a folding member is advanced slowly towards and into engagement with the blank, whereupon it is accelerated beyond the path to the other side thereof. The deflecting member is then withdrawn and the deflected portions of the blank are engaged between two rollers which rotate in mutually opposite directions and the blank is thereby folded by engagement with these rollers through the nip of which it passes.

6 Claims, 3 Drawing Figures

FOLDING OF SHEET-MATERIAL BLANKS

This is a division, of application Ser. No. 301,603, fled Oct. 27, 1972, now U.S. Pat. No. 3,904,187.

BACKGROUND OF THE INVENTION

The present invention relates to the folding of sheet-material blanks and more particularly to a method and an apparatus for effecting such folding.

Sheet-material blanks must frequently be folded, for instance to form a signature in a book, brochure or the like. Such folding is ususally carried out by means of a longitudinal or transverse folding device associated with so-called rotary folders of the type used in various rotary printing machines which use sheet material. As a rule, these folding devices use a conically or analogously convergent guide in which the sheet material blank is made to advance whereby it becomes progressively folded. Another approach known from the art is to use transverse folding cylinders. In some instances, where the fold must be carried out with particular accuracy, so-called knife-folders are employed. These "knives" are folding elements which are guided to perform a movement during which they engage the respective sheet material blank and fold it. It is known to guide the knife in a straight-line guide or to articulate it to a swingable arm.

The problem with these latter types of folders is the drive for the movement which is to be performed by the knife, particularly if the knife is required to form a fold on a large-format sheet-material blank. This means that the knife must pass through a relatively significant stroke, and of course in modern equipment the high-speed operation of the machines necessitates that the number of strokes be correspondingly great. This means that a cam control of the knife movement, the inherently ideal way of controlling the movement, is no longer possible. It has already been attempted to effect the control by means of electromagnetic units. These last two types of drive arrangements have the disadvantage that the number of strokes which is required in modern machines per unit of time, cannot be achieved. Moreover, the drives accelerate the knife or deflecting element in such a manner that it engages the respective sheet-material blank in shock-like manner, a disadvantage in terms of the accuracy of folding which can be obtained.

Some improvement was obtained in this field by using straight-line articulated crank linkages. Such crank linkages are driven and the output member of the linkage is associated with the knife which it then moves in a straight line. The difficulty with these arrangements is that the speed of movement of the last element, that is here the knife, decreases significantly long before the knife reaches the end of its working stroke. This means that that the sheet-material blank engaged by the knife receives only a relatively brief but very strong impulse deflecting it out of the path in which it travels, but is not positively guided subsequently because of the progressive retardation in the speed of advancement of the knife. Thus, the deflected portions of the sheet-material blank will slide more or less freely under the impulse initially imparted to them by the knife, in the direction in which they have been deflected by the knife, before they are engaged by the folding rollers which then complete the folding operation. In many instances, however, the sheet-material blanks have already previously been folded by means of conical folding guides or other devices, so that they are of V-shaped configuration, that is they are already bi-folded in one direction. This means that at the opposite sides of the sheet-material blank, that is at the opposite lateral edges thereof, different stiffness and friction coefficients exist. This, in turn, means that as soon as the blank is no longer positively guided by contact with the knife, it will tend to shift its configuration and position and depending upon the mass and the speed of the initial impulse imparted to it, it will reach the folding rollers at some angle of inclination. This, as is well known to thse conversant with the art, results in various types of difficulties.

SUMMARY OF THE INVENTION

It is, accordingly, an object of the present invention to avoid the disadvantages of the prior art.

More particularly it is an object of the present invention to provide an improved folding apparatus for folding of sheet-material blanks, which is not possessed of the aforementioned disadvantages.

Another object of the invention is to provide an improved method of effecting the folding of sheet-material blanks.

In pursuance of these objects, and of others which will become apparent herefter, one feature of the invention resides in guiding a sheet-material blank in a predetermined path, and advancing a deflecting element (e.g. a folding knife) at relatively slow speed from one side of the path toward and into engagement with the blank. Thereupon, the deflecting element is accelerated and simultaneously advanced together with portions of the blank out of the path and to the opposite side of the latter, where such portions can be engaged by the folding rollers. According to the invention the acceleration of the deflecting element assures that it will always be in positive guiding engagement with the deflected portions of the sheet-material blank so that the disadvantages of the prior art cannot occur.

The apparatus for carrying out the novel method is capable of producing at high speed and can therefore be employed to economic advantage. The invention is applicable both to transverse folders and to longitudinal folders, that is apparatuses which effect transverse or longitudinal folding of sheet material blank. It assures that the deflecting element engages the sheet-material blank at low speed, rather than to impart a strong impulse thereto. Once the blank has been engaged, the deflecting element is accelerated together with the blank and the latter is thus being positively guided by continued engagement with the deflecting element until the deflected portions of the sheet-material blank have reached a position in which they can be engaged by the folding rollers.

According to a currently preferred embodiment of the invention we utilize an articulated crank linkage which drives the deflecting element in a straight-line path, and whose movemment is in turn controlled by so-called anti-parallel crank linkages. The output member of the anti-parallel crank linkage is at one and the same time also the input member of the straight-line crank linkage arrangement. However, it is also possible to use, in place of the anti-parallel crank linkages, elliptically configurated wheels.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the acompanying drawing.

DESCRIPTION OF THE PREFERRED EMBODIMENTS

Figure 1:
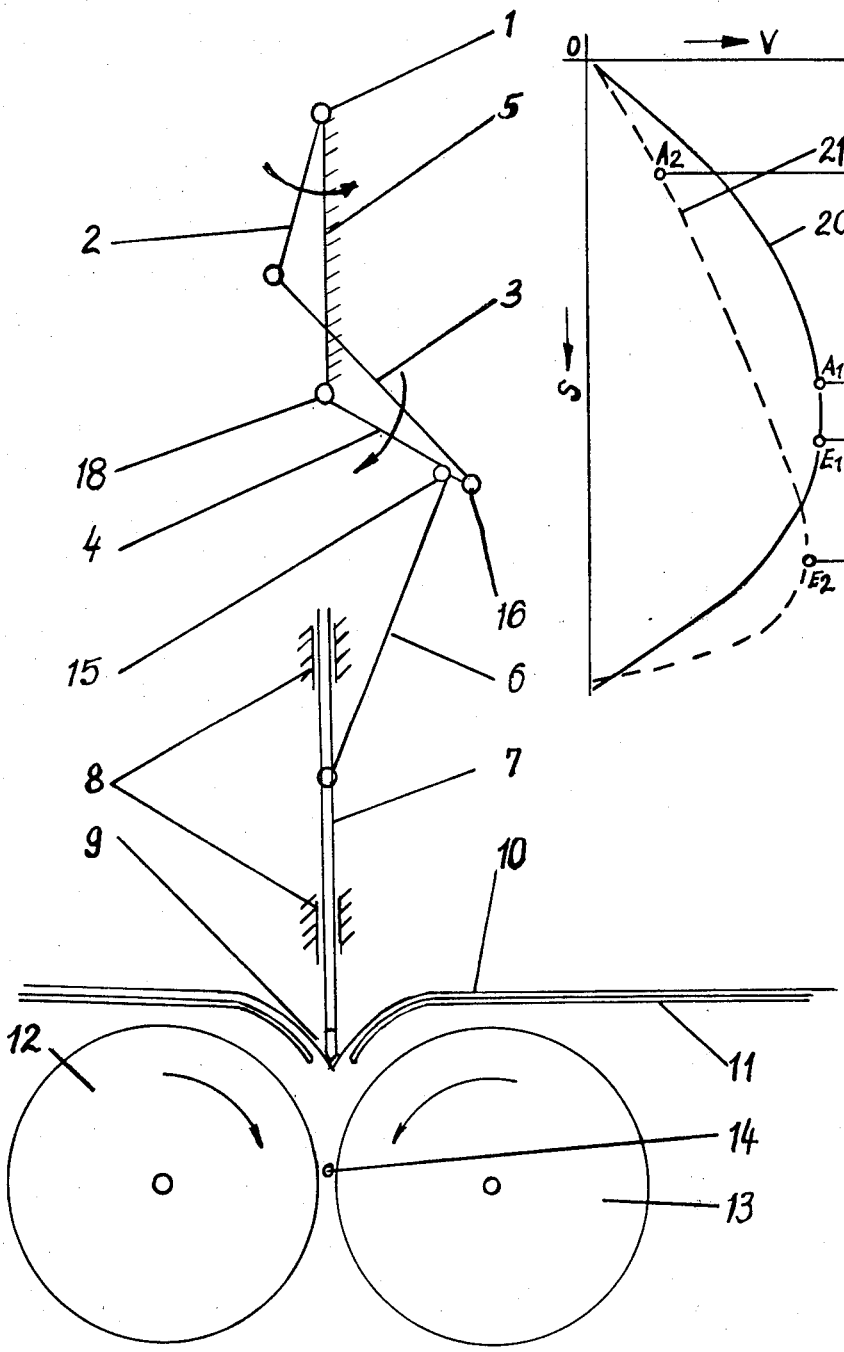
FIG. 1 is a somewhat diagrammatic side view illustrating one embodiment of the invention.

Discussing firstly the embodiment in FIG. 1 it will be seen that reference numeral 1 designates a somewhat diagrammatically illustrated rotatable drive shaft 1 which drives a crank 2 which, together with a coupling element 3, a crank 4 and a fixed element 5 constitutes a counter-motion anti-parallel crank drive in which during rotation of the crank 2 in one direction the crank 4 connected thereto by the coupling element 3 rotates in the opposite direction of rotational speeds different from those of the crank 2. In accordance with the present invention the crank 4 is the output element of the anti-parallel crank drive, but at the same time is also the input or drive crank of the straight-line crank linkage arrangement which, in addition to the crank 4, has the coupling element 6, the glide rod 7 which carries at its front the deflecting element 9, and the straight-line guide 8.

Reference numeral 11 identifies a guide having the illustrated slot which registers with the nip 14 and find between two folding rollers 13 and 12 which rotate in mutually opposite directions as illustrated by the associated arrows. The sheet-material blanks 10, of which one is shown, advance on this guide 11 in a predetermined path, defined by the surface of the guide 11 which faces upwardly in FIG. 1. They move across the gap in the guide 11 and it will be understood that they have previously been severed from endless webs of sheet material, that they may have been printed or otherwise processed, that they may have been folded longitudinally and/or transversely and that there may be more than one of these blanks 10 provided on the guide 11 in overlying relationship. In other words, it is possible to fold two or more of the blanks 10 simultaneously.

It is clear that when the element 9 moves from one side of the path (the upper side in FIG. 1) across the path to the other side (the lower side in FIG. 1), it deflects the blank 10 as illustrated through the slot in the guide 11. Depending upon the length of the stroke required to be performed by the element 9, the coupling element 6 may be pivoted at a pivot 15 or if maximum stroke length is required, at the pivot 16 which in any case exists and connects the coupling element 3 with the crank 4. It is also possible, however, to provide an arrangement in which the pivot 15 can be shifted on the crank 4 in order to permit the stroke length to be varied if and as required.

Figure 2:
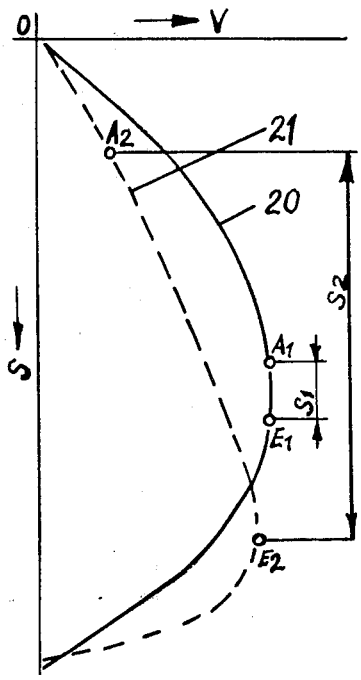
FIG. 2 is a graph comparing the characteristics of movement of the deflecting element in an apparatus according to the present invention and in accordance with the prior art.

If the arrangement uses only a single straight-line crank linkage arrangement, for instance that illustrated in FIG. 1 and comprising the crank 4, the coupling element 6, the rod 7 and the guide 8, as is known from the prior art, then the element 9 will be undergoing only insignificant acceleration at the time it contacts the blank 10 at point $A_1$ (see FIG. 2), as indicated by the solid line in FIG. 2, The acceleration which the element 9 has at the time it contacts the blank 10 at point $A_1$, is maintained over only a short period $S_1$ until the point $E_1$ is reached. FIG. 2 shows clearly that the speed of the element 9 decreases quite rapidly in the direction towards the point $E_1$, so that the deflected blank 10 is no longer being positively guided by engagement with the element 9 and will be able to move relatively freely (without guidance) in the direction towards the nip 14 (FIG. 1).

Relatively expensive attempts have been made to overcome this problem in the art, for instance to retard the blank 10 by brake or friction rollers located above the guide 11, so as to prevent the free movement of the deflected portions of the blank, that is movement which is continued at the initial speed of deflection whereas the element 9 is progressively retarded. Even this, however, has been of no help in the prior art and especially due to the fact that the blanks 10 have usually already been previously folded one or more times, the problems occur which have been outlined above, as soon as the non-positively guided blank is then engaged by rollers 12 and 13.

The present invention, however, avoids these difficulties. FIG. 2 shows that during the working stroke of the element 9 there is obtained a distance-speed relationship as is indicated by the broken line 21 in FIG. 2. It will be noted that the element 9 engages the blank 10 at point $A_2$ with relatively low speed and that it then accelerates the blank increasingly until it extends substantially beyond the guide 11; the acceleration of the element 9 and consequently of the blank 10 is terminated only when the nip 14 has almost been reached, that is it is terminated almost at point $E_2$ where the working stroke of the element 9 ends. This means that the difficulties inherent in the prior art have been avoided, because any undesired displacement of the blank 10 is no longer possible because it has already been engaged by the rollers 13 and 14 and is positively guided by them.

If, in accordance with the prior art, only a straight-line crank linkage drive is utilized, guidance of the blanks 10 can be effected only in the region $s_1$ of FIG. 2, that is between the point of contact $A_1$ which is reached at almost maximum speed and the point $E_1$. In contradistinction thereto, the present invention makes it possible to positively guide the blank 10 over a substantially longer distance $s_2$, extending between the contact point $A_2$ which is reached at relatively low speed of the element 9, and the point $E_2$ which is almost coincident with the end of the working stroke of the element 9. This means that at identical angular speed of the respective crank drive and at better utilization of the operating rhythm, an improvement of the folded blanks, that is the quality of the folds thereof, is obtained with the present invention. This is obtained by having the movement of the element 9, and therefore the deflection of the blank 10, be continuous in accordance with the present invention and by guiding the blank 10 positively from the moment it is deflected out of its path until it is engaged by the rollers 12 and 13 at the nip 14 thereof.

Figure 3:
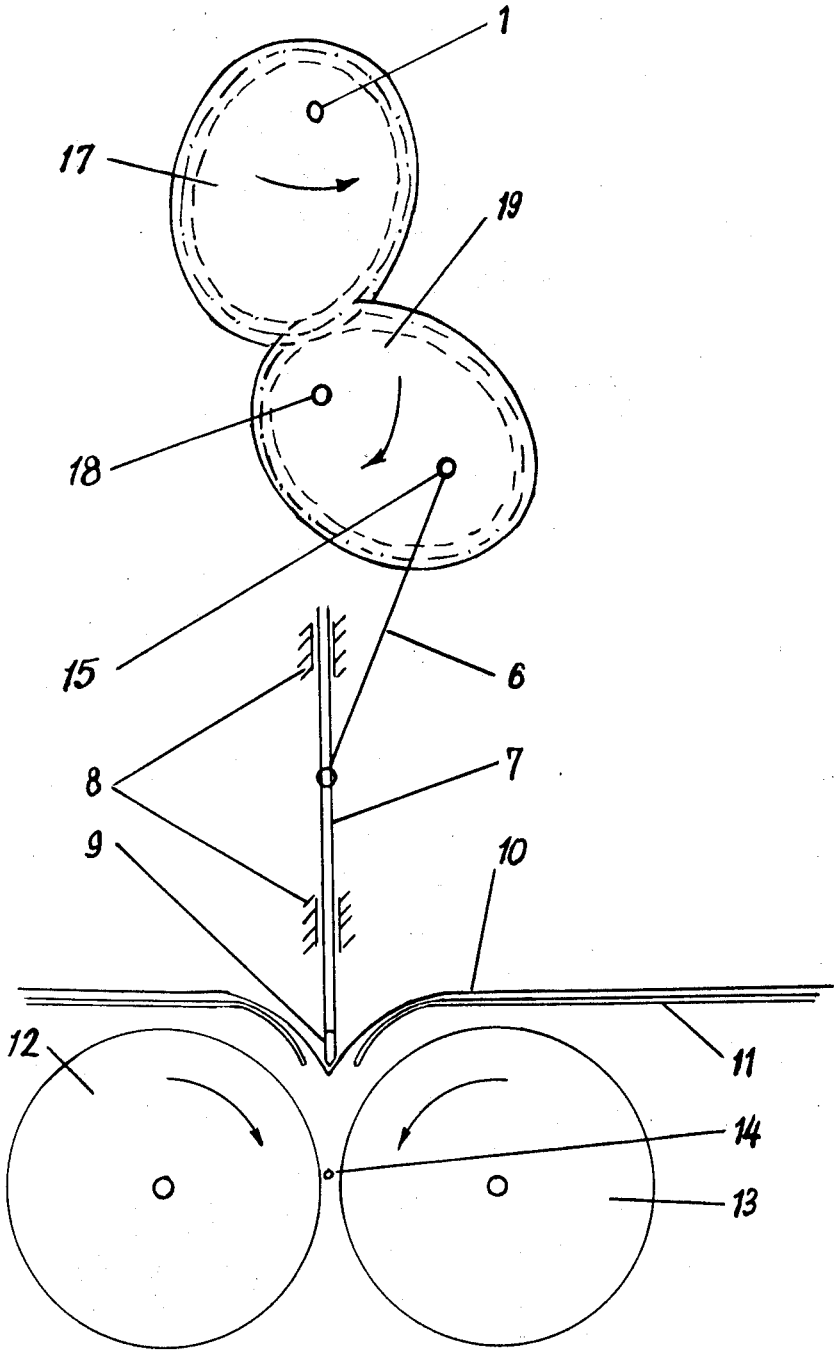
FIG. 3 is analogous to FIG. 1 but illustrating a further embodiment of the invention.

In FIG. 3 we have illustrated a further embodiment of the invention. Like reference numerals identify the same components as in the emodiment of FIG. 1. Here, however, we have illustrated that in place of the anti-parallel cranks 2–5 it is possible to mount on the drive shaft 1 an elliptical wheel 17 which cooperates with an elliptical wheel 19 of identical size and which is mounted for rotation on a shaft 18. The spacing of the axis of the shaft 18 from the axis of the shaft 1 corresponds to the distance of the fixed points of articulation of the member 5 of the embodiment in FIG. 1. The coupling member 6 would then have to be articulated on the large elliptical axis of the wheel 19. The data given in FIG. 2 with respect to the operation of the embodiment of FIG. 1, and the comparison with the prior art which is provided in FIG. 2, hold identically true with respect to the embodiment of FIG. 3.

It will be understood that each of the elements described above, or two or more together, may also find a useful application in other types of constructions differing from the types described above.

While the invention has been illustrated and described as embodied in an apparatus for folding sheet-material blanks, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In an apparatus for folding sheet material blanks, a combination comprising guide means for guiding sheet material blanks, substantially in a plane; a deflecting element guided for straight-line movement in a direction transversely of said plane from a starting position in which it is located in its entirety at one side of said plane to an operating position in which it extends with a portion thereof across said plane to the other side of the latter, whereby to engage and in part deflect the blank in said direction; and motion-imparting means for imparting motion to said element in such a manner that the element moves from said starting position to said plane and travels at relatively slow speed when reaching sheet material located in said plane and upon reaching said sheet material is accelerated to a relatively higher speed while travelling from said plane toward said operating position, said motion-imparting means comprising an anti-parallel crank linkage mounted at said one side of said plane and including a fixedly mounted and rotatable drive shaft which is spaced from said element laterally of said plane, a first crank link having a free first end and a second end which is connected to said drive shaft for turning with the same, a second crank link also having a free first end and a second end which is pivotally mounted at a fixed location which is spaced from said drive shaft in direction towards said plane, spaced ends each of which is pivoted to a different one of said first ends, and a motion-transmitting element having opposite end portions which are pivoted to said first end of said second crank link and to said element, respectively, so that, in response to rotation of said drive shaft, said crank links pivot in mutually opposite directions and impart motion to said element in said manner.

2. A combination as defined in claim 1, wherein said crank linkage further comprises an elongated stationary member having one end portion at said drive shaft and another end portion to which said second end of said second crank link is pivotally mounted at said fixed location.

3. A combination as defined in claim 1; and further comprising a pair of transversely spaced folding rollers mounted at said other side of said plane for rotation in opposite directions about axes extending substantially parallel to said plane, said folding rollers defining between themselves a gap which is aligned in said direction with said deflecting element so that the part of said blank that is deflected by said deflecting element enters said gap.

4. A combination as defined in claim 3, wherein said guide means comprises a guide support having a slot which registers in said direction with said deflecting element and said gap, respectively.

5. A combination as defined in claim 1; and further comprising an elongated guide element mounted at said one side of said plane and guiding said deflecting element for said straight-line movement thereof.

6. A combination as defined in claim 1, wherein said coupling element has a length which is greater than the length of said first and second crank links, respectively.

* * * * *